US007668328B2

(12) United States Patent
Rosenthal et al.

(10) Patent No.: US 7,668,328 B2
(45) Date of Patent: Feb. 23, 2010

(54) ADJUSTING AND DISPLAY TOOL AND POTENTIOMETER

(75) Inventors: Joyce Rosenthal, Golden Valley, MN (US); John Stolte, Burnsville, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 723 days.

(21) Appl. No.: 10/827,706

(22) Filed: Apr. 20, 2004

(65) Prior Publication Data

US 2005/0244021 A1 Nov. 3, 2005

(51) Int. Cl.
*H04R 25/00* (2006.01)

(52) U.S. Cl. ..... 381/329; 381/322

(58) Field of Classification Search ..... 381/312, 381/314, 322, 323, 324, 328, 329, 380; 607/56, 607/57; 600/25; 338/198, 200
See application file for complete search history.

(56) References Cited

U.S. PATENT DOCUMENTS

| | | | | |
|---|---|---|---|---|
| 4,739,512 | A | 4/1988 | Hartl et al. | |
| 4,803,458 | A * | 2/1989 | Trine et al. | 338/198 |
| 5,265,168 | A | 11/1993 | Schiess et al. | |
| 5,271,063 | A | 12/1993 | d'Alayer de Costemore d'Arc | |
| 5,852,668 | A | 12/1998 | Ishige et al. | |
| 6,058,197 | A | 5/2000 | Delage | |
| 6,130,950 | A | 10/2000 | Martin | |
| 6,175,635 | B1 | 1/2001 | Meyer et al. | |
| 6,549,635 | B1 | 4/2003 | Gebert | |
| 6,567,524 | B1 | 5/2003 | Svean et al. | |
| 6,590,987 | B2 | 7/2003 | Delage | |
| 6,937,738 | B2 | 8/2005 | Armstrong et al. | |
| 7,184,564 | B2 | 2/2007 | Rosenthal | |
| 7,221,769 | B1 * | 5/2007 | Jorgensen | 381/328 |
| 2002/0094098 | A1 | 7/2002 | Delage | |
| 2004/0240693 | A1 | 12/2004 | Rosenthal | |

* cited by examiner

*Primary Examiner*—Huyen D Le
(74) *Attorney, Agent, or Firm*—Schwegman, Lundberg & Woessner, P.A.

(57) ABSTRACT

An adjusting tool having two electrical contacts provides a means for measuring an electrical signal that is used for adjusting electrical parameters of an object as the object is being physically adjusted by the adjusting tool. In an embodiment, the adjusting tool is configured such that the two electrical contacts make electrical contact with electrical contacts of a potentiometer of a hearing aid to receive an adjustment signal that is also applied to circuits in the hearing aid. The two electrical contacts of the adjusting tool maintain electrical contact with the electrical contacts of the potentiometer as the adjusting tool physically adjusts the potentiometer. In an embodiment, the adjusting tool includes a display to provide a visual representation of the adjustment signal as the potentiometer is adjusted.

22 Claims, 11 Drawing Sheets

ADJUSTING AND DISPLAY TOOL AND POTENTIOMETER

FIELD OF THE INVENTION

The present invention relates generally to hearing aids, and more particularly, to adjustment of hearing aids.

BACKGROUND

Hearing aids have adjustable operational parameters that improve the performance of the hearing aid for a specific person or for specific environments. Such adjustable operational parameters include, for example, gain and output. Hearing aids based on analog circuitry may have operational parameters that can be adjusted by a potentiometer. Most analog hearing aids are not programmable. Digital hearing aids, on the other hand, are typically programmable and offer more sophisticated performance. Digital hearing aids often include memory and processor capability and operate based on data stored in the digital hearing aid. The operational parameters of such a digital hearing aid are determined from the stored data, where the data is programmed by software run on a computer coupled to a programming port in the digital hearing aid.

Digital hearing aids are more flexible, sophisticated than analog hearing aids, but require the use of a computer for programming. Hearing aid dispensers may be reluctant to sell digital hearing aids for any number of reasons including:

- They may prefer making potentiometer adjustments for the end-user rather than making adjustments by computer.
- They may prefer the portability of a screwdriver to the portability of a computer. They may frequently do fittings outside the office and would have to carry a laptop computer around to fit/adjust digital hearing aids.
- They may not want to invest in computer equipment for the office.
- They may be unfamiliar with and/or intimidated by computers.

The frequency response of a non-programmable, analog hearing aid is controlled via the adjustment of one or more potentiometers. Adjustment of a potentiometer, or trimpot, requires the use of a small screwdriver designed to fit in the shallow indentation that spans the diameter of the trimpot. A typical trimpot diameter is 0.10". Rotation of a trimpot in the clockwise or counterclockwise direction causes a continuous change in one or more response characteristics. Examples of parameters typically controlled through trimpot adjustment include gain, output, high pass filter characteristics, and low pass filter characteristics. A response range defines the behavior for a given trimpot. The minimum and maximum of the response range are defined by the points at which the trimpot is rotated fully either clockwise or counter-clockwise, but precise intermediate settings are not specified.

The frequency response of a digital hearing aid is typically controlled via adjustments made on a computer while the hearing aid is connected to it by a cable. The desired response is then saved to the device before it is disconnected from the computer. However, digital hearing aids can also be controlled via the adjustment of potentiometers, as is done with analog devices. The variable resistor inside the potentiometer is connected to an analog to digital (A/D) converter in the hearing aid that converts the voltage across the resistor to a discrete parameter value. The number of discrete values for a given parameter depends on the precision of the A/D converter. A 4-bit A/D converter, for example, will map the full range of trimpot positions to 16 discrete settings. It may be desirable in some cases, however, to be able to make precision adjustments to the hearing aid without the use of a computer.

There exists a need for improved digital hearing aids and improved methods for adjusting the operational parameters of digital hearing aids.

SUMMARY

The above mentioned problems are addressed by the present invention and will be understood by reading and studying the following specification. An adjusting tool having two electrical contacts in the head of the adjusting tool provides a means to measure an electrical signal that is used for adjusting electrical parameters of an object as the object is being adjusted by the adjusting tool. In an embodiment, the adjusting tool is configured such that the two electrical contacts make electrical contact with electrical contacts of a potentiometer of a hearing aid, where the potentiometer provides an adjustment signal between the two electrical contacts of the adjusting tool that is also applied to circuits in the hearing aid. In an embodiment, the adjusting tool includes a display to provide a visual representation of the adjustment signal as the potentiometer is adjusted.

These and other aspects, embodiments, advantages, and features will become apparent from the following description and the referenced drawings.

DETAILED DESCRIPTION

Figure 1A:
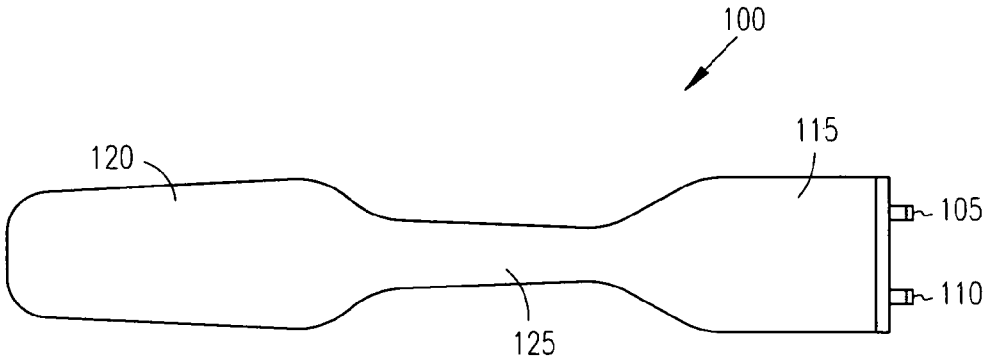
FIG. 1A depicts an embodiment of an adjusting tool having two electrical contacts in the head of the adjusting tool, according to the teachings of the present invention.

In the following detailed description of the invention, reference is made to the accompanying drawings which form a part hereof, and in which are shown by way of illustration, specific embodiments in which the inventions may be practiced. These embodiments are described in sufficient detail to enable those skilled in the art to practice the invention, and it is to be understood that other embodiments may be utilized and that process, electrical or mechanical changes may be made without departing from the scope of the present invention.

In an embodiment, electrical contact to a potentiometer's variable resistor is made on the outside of an object that is being electrically adjusted by the potentiometer. The adjusting apparatus, or adjusting tool, is a screwdriver-like device having a head to physically adjust the potentiometer and electrical contacts on the head of the screwdriver for receiving an electrical signal representative of the electrical signal that is applied to a circuit to which the potentiometer is coupled. Herein, a screwdriver-like device, acting as an electrical screwdriver, that is used to physically adjust an object such as by turning clockwise or counter-clockwise may be referred to as a screwdriver. The head of such a screwdriver includes a portion of the screwdriver that engages and physically adjusts the potentiometer. The adjusting tool and the head may be realized in a variety of configurations and is not limited to the configuration of typical screwdrivers.

The electrical signal received by the adjusting tool may be viewed by a display. The display can be realized as an analog display such as a meter device that has an arm that moves in response to the electrical signal, where reading a marking on the meter aligned with the arm provides a reading or a value correlated to a parameter of an object being adjusted by the potentiometer. The display can be realized as a digital display for representing the parameter of the display being adjusted in which a representative adjusting signal has been processed by an analog-to-digital converter. In an embodiment, the potentiometer is mounted in or on the surface of a hearing aid.

In general, a potentiometer is a device for the measurement of an electromotive force by a comparison with a known potential difference. The comparison may be made by adjusting a sliding contact to select a portion of the known potential difference. The selected portion may range from zero to the full known potential difference. The mechanism for the sliding contact may include a variety of configurations. A potentiometer can be realized as a variable resistor used as a voltage divider, where a supply voltage or reference voltage is applied across the entire variable resistor, or resistance element, with an output voltage taken from a wiper, or moveable contact making electrical contact along the resistive element. The output voltage is typically taken relative to one end of the resistive element, where one end of the resistive element is usually grounded (at zero potential). A potentiometer can also be implemented as a nulling device whose operation is based on a variable resistor.

In an embodiment, an adjusting tool with a built-in analog to digital converter that makes contact with both the variable resistor and a common ground element in a hearing aid potentiometer can be used to read and display the discrete parameter setting determined by the potentiometer position. This adjusting tool provides a straight forward and inexpensive method to precisely set potentiometer-controlled parameters in digital hearing instruments without the aid of a computer.

A hearing aid is a hearing device that generally amplifies sound to compensate for poor hearing and is typically worn by a hearing impaired individual. In some instances, the hearing aid is a hearing device that adjusts or modifies a frequency response to better match the frequency dependent hearing characteristics of a hearing impaired individual.

FIG. 1A depicts an embodiment of an adjusting tool 100 having two electrical contacts 105 and 110 in the head 115 of the adjusting tool 100. The form of adjusting tool 100 may take the shape of a standard screwdriver with a handle 120 and an extension 125. In an embodiment, head 115 is formed of insulating material such that electrical contacts 105, 110 can receive an electrical signal from an object being adjusted by adjusting tool 100. Electrical contacts 105, 110 are configured to provide a signal received between electrical contacts 105, 110 as adjusting tool 100 engages an object to be adjusted. In an embodiment, the signal received between electrical contacts 105, 110 is received from the object being adjusted. In an embodiment, the signal received between electrical contacts 105, 110 is provided to the object being adjusted.

In an embodiment, head 115 and extension 125 are formed of a metallic material such as is commonly used in typical non-electric screwdrivers with insulating material surrounding electrical contacts 105, 110 and leads from these contacts to handle 120 such that electrical contacts 105, 110 can receive an electrical signal from an object being adjusted by adjusting tool 100. In an embodiment, at least one of electrical contacts 105, 110 is electrically insulated from the head of adjusting tool 100. In an embodiment, one of electrical contacts 105, 110 is electrically coupled to head 115 of the adjusting tool 100 for grounding purposes.

An electronic circuit may be housed in handle 120 to process the electrical signal received at electrical contacts 105, 110. Alternately, an electronic circuit is housed in head 115 to process the electrical signal received at electrical contacts 105, 110. In an embodiment, head 115 of adjusting tool 100 is adapted to physically adjust a potentiometer with the electrical contact 105 configured to electrically couple to a first potentiometer contact and electrical contact 110 configured to electrically couple to a second potentiometer contact as adjusting tool 100 adjusts the potentiometer. In an embodiment, electrical contacts 105, 110 of adjusting tool 100 maintain electrical contact with the electrical contacts of the potentiometer as adjusting tool 100 physically adjusts the potentiometer.

Figure 1B:
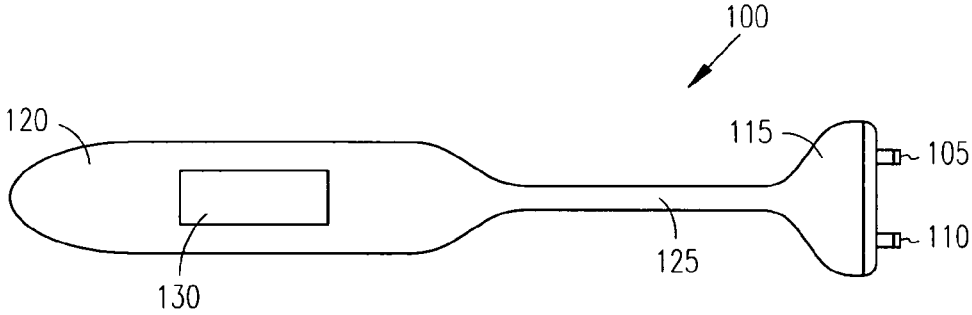
FIG. 1B depicts an embodiment of an adjusting tool shown in FIG. 1A having two electrical contacts in the head of the adjusting tool and also having a display on the handle of the adjusting tool, according to the teachings of the present invention.

FIG. 1B depicts an embodiment of adjusting tool 100 shown in FIG. 1A having electrical contacts 105, 110 in head 115 and also having a display 130 on handle 120. An electrical signal received by adjusting tool 100 between electrical contacts 105, 110 may be viewed by display 130. In an embodiment, display 130 provides a reading representative of the electrical signal received by adjusting tool 100 between electrical contacts 105, 110. Display 130 can be realized as an analog display such as a meter device that has an arm that moves in response to the electrical signal, where reading a marking on the meter aligned with the arm provides a value correlated to a parameter of an object being adjusted by the potentiometer. Display 130 can be realized as a digital display for representing the parameter of the display being adjusted in which a representative adjusting signal has been processed by an analog-to-digital converter. In an embodiment, a parameter is presented in a numerical format. In an embodiment, head 115 of adjusting tool 100 is configured as a flat head, and display 130 is a digital display visible on handle 120 attached to head 115 of adjusting tool 100. Digital display 130 includes light emitting diodes.

Figure 1C:
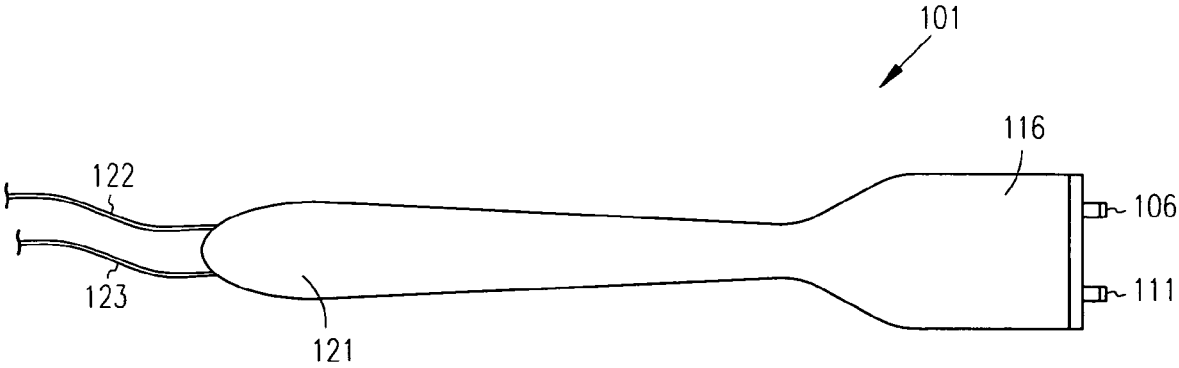
FIG. 1C depicts an embodiment of an adjusting tool having two electrical contacts in the head of the adjusting tool and leads to output a signal representative of a signal received between the two electrical contacts, according to the teachings of the present invention.

FIG. 1C depicts an embodiment of an adjusting tool 101 having two electrical contacts 106, 111 in a head 116 of adjusting tool 101 and leads 122, 123 to output a signal representative of a signal received between electrical contacts 106, 111. Leads 122, 123 are provided from a handle 121 for connection to a measuring device to read a signal applied between electrical contacts 106, 111 as adjusting tool is applied to an object to adjust the object. Leads 122, 123 can be connected to a measuring device with an analog display or to a measuring device with a digital display. In an embodiment, adjusting tool 101 includes an analog-to-digital converter such that leads 122, 123 provide a digital signal to a measuring device.

Figure 1D:
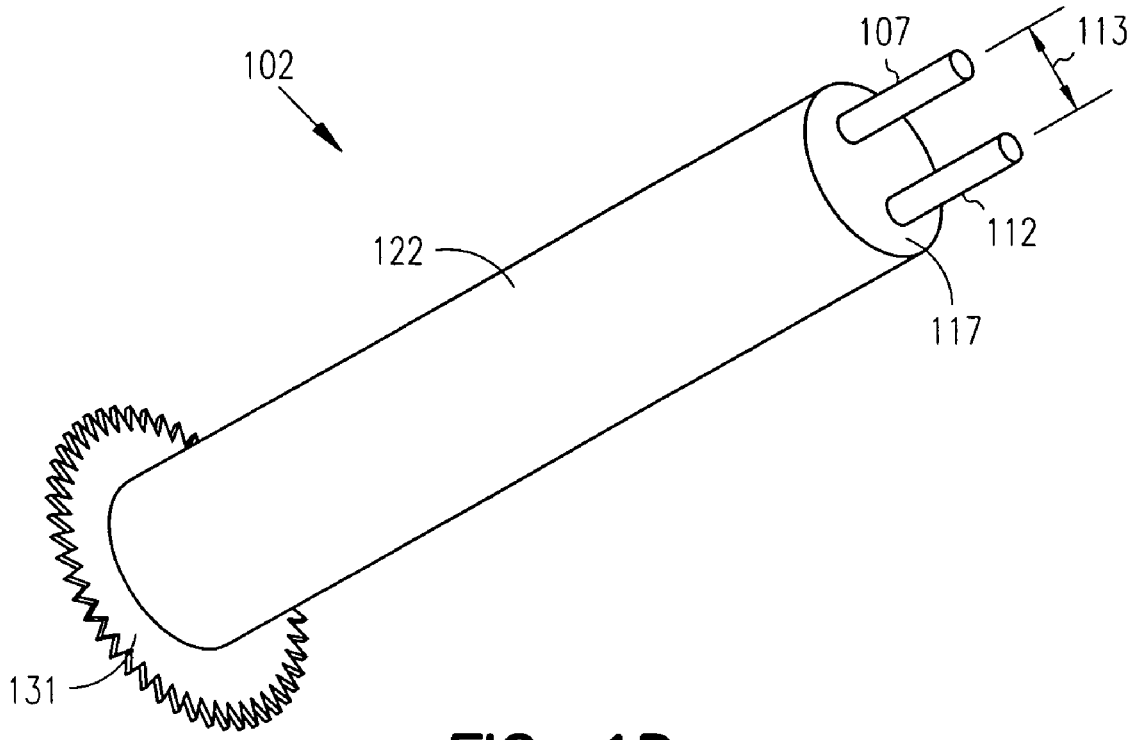
FIGS. 1D-1E depict two views of another embodiment of an adjusting tool having two electrical contacts in the head of the adjusting tool, according to the teachings of the present invention.

FIG. 1D depicts another embodiment of an adjusting tool 102 having two electrical contacts 107, 112 in a head 117 of adjusting tool 102 having a body 122 and a display 131. Head 117 is a relatively flat surface upon which electrical contacts 107, 112 are mounted. Electrical contacts 107, 112 are separated by a distance 113. In an embodiment, distance 113 is about 0.10 inches. In an embodiment, electrical contacts 107, 112 provide at least two functions: to electrically contact an object to receive a signal from the object and to physically contact an object to physically adjust the object. Electrical contacts 107, 112 can take several forms including a cylindrical shape or a rectangular shape. Body 122 may be composed of an insulating material such as a plastic or a metallic material. For embodiments, in which body 122 and head 117 are metallic, electrical contacts are surrounded by a material, such as a plastic or a ceramic, providing electrical insulation from body 122 and head 117.

Figure 1E:
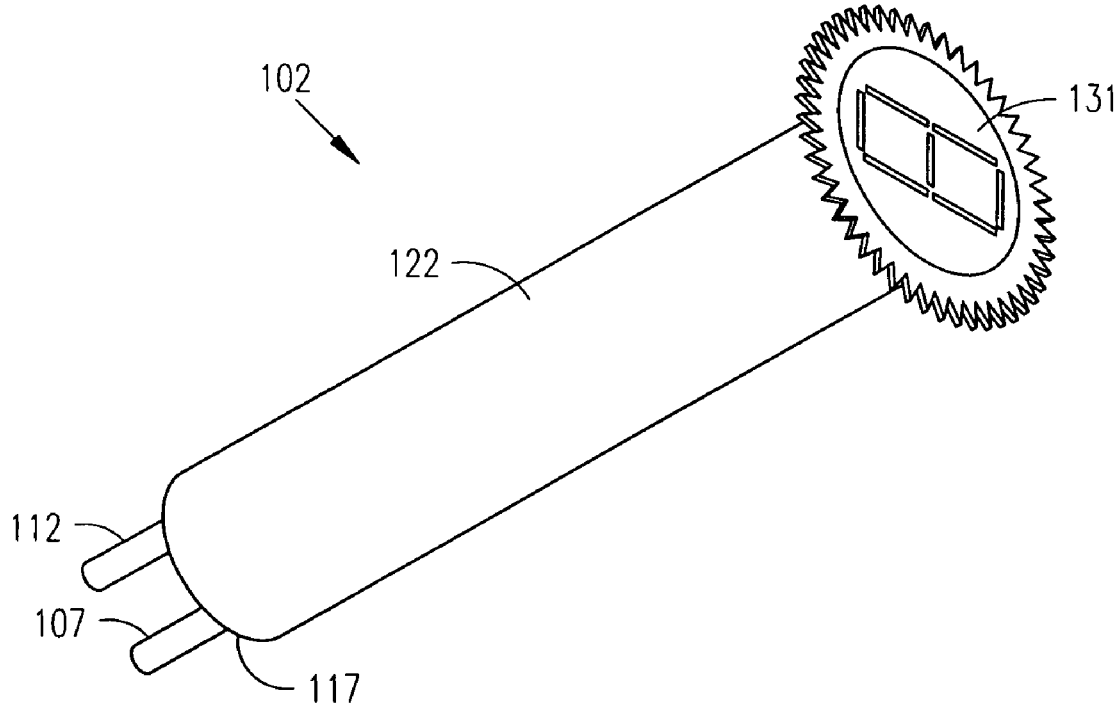

FIG. 1E illustrates a view of the embodiment of FIG. 1D showing a display 131 on an end of adjusting tool 102. Display 131 may be an analog display or a digital display. In an embodiment, adjusting tool 102 is used to adjust parameters of small objects, such as hearing aids, and provides a digital display 131. Digital display 131 receives input from an A/D converter within adjusting tool 102 that receives an electrical signal from between electrical contacts 107 and 112 as adjusting tool 102 physically adjusts an object. In an embodiment, display 131 is configured along body 122 rather than on an end of adjusting tool 102.

Figure 2A:
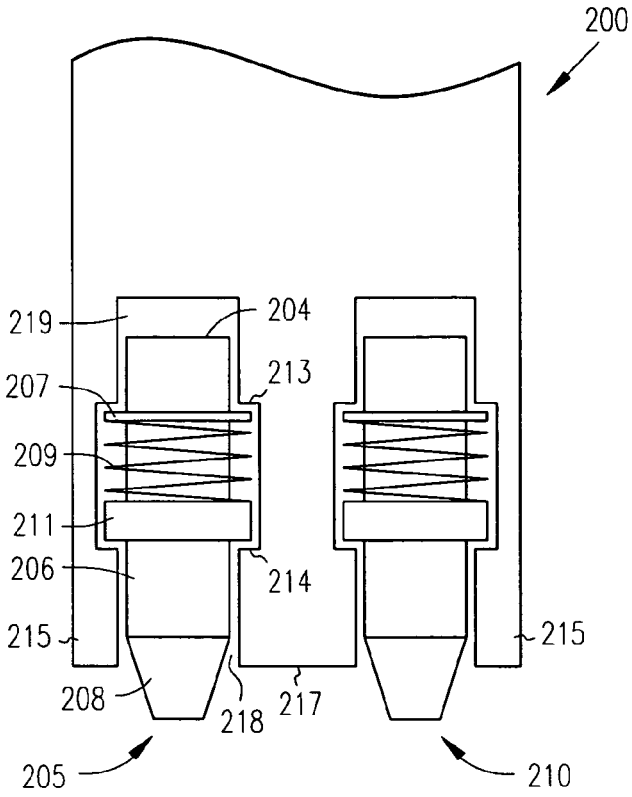
FIGS. 2A-2B depict an embodiment of electrical contacts in the head of an adjusting tool in a non-contacting position and a contacting position, according to the teachings of the present invention.
Figure 2B:
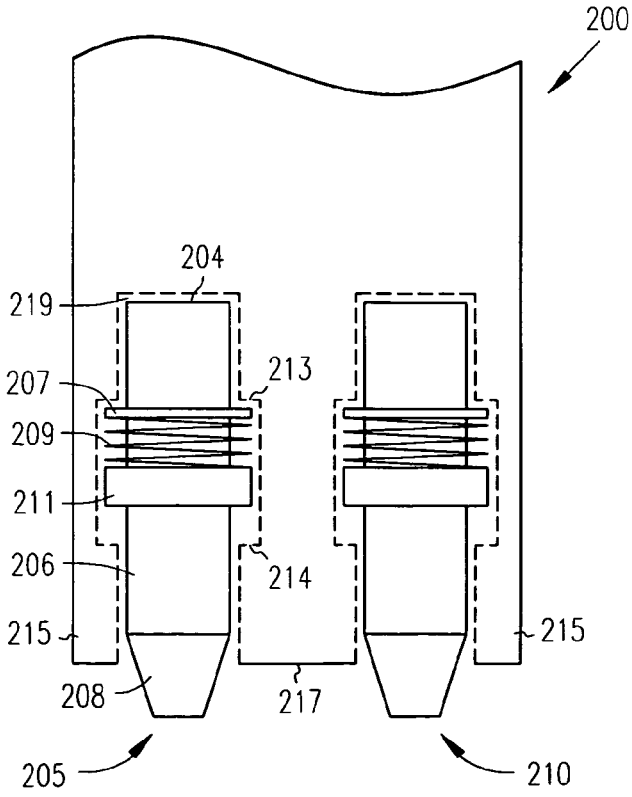

FIGS. 2A-2B depicts an embodiment of electrical contacts 205, 210 in a head 215 of an adjusting tool 200 in a non-contacting position and a contacting position. Electrical contact 205 is located in a recess 219 in head 215. Electrical contact 205 has a electrically conductive body 206 coupled to a washer 207 by a spring 209 with a portion of conductive body 206 that protrudes outside recess 219. Conductive body 206 is movable inside recess 219. Spring 209 is adapted to compress to allow conductive body 206 to move into recess 219 as contact 205 is forced into contact with a receptacle, where electrical contact 205 maintains electrical contact with the receptacle as adjusting tool 200 adjusts the receptacle. Electrical contact 210 is configured similar to contact 205 with regards to construction, location, and coupling, and moves into a corresponding recess as contact 210 is forced into contact with a receptacle, where electrical contact 210 also maintains electrical contact with the receptacle as adjusting tool 200 adjusts the receptacle. FIG. 2B illustrates the compression of spring 209 as head 215, or blade 215, makes contact with an object to be adjusted by adjusting tool 200. Electrical contacts 205 and 210 maintain electrical connection with electrical contacts of the object to be adjusted as adjusting tool 200 physically adjusts the object.

In an embodiment as shown in FIGS. 2A and 2B, each electrical contact 205, 210 includes a conductive cylinder 206 with a flat end 204 and a tapered end 208 movable inside a cylindrical cavity 219, or recess 219, in head 215. Each conductive cylinder 206 has a cylindrical collar 211 fixed between flat end 204 and tapered end 208 with an outside diameter larger than an outside diameter of the conductive cylinder 206. Each collar 211 has a diameter larger than a diameter of the cylindrical cavity 219 at a first ledge 213 and at a second ledge 214. Tapered end 208 of each conductive cylinder 206 extends past an exterior surface 217 of head 215 through an opening 218 in head 215. For each conductive cylinder 206, a flat washer 207 is positioned inside the recess 219 between collar 211 and first ledge 213 at which there is a hole through which the conductive cylinder 206 slides. Spring 209 is wrapped around the conductive cylinder 206 between washer 207 and collar 211 to force collar 211 away from washer 207 toward the second ledge 214 and to force tapered end 208 to extend through the opening 218 until collar 211 meets second ledge 214 of cavity 219. For each conductive cylinder 206, spring 209 is adapted to compress to allow conductive cylinder 206 to move back into the cylindrical cavity 219 as electrical contact 205 and electrical contact 210 are forced into electrical contact with a receptacle. In an embodiment, the conductive body 206 protrudes from surface 217 a distance ranging from 15 to 25 thousandths of an inch.

Figure 3:
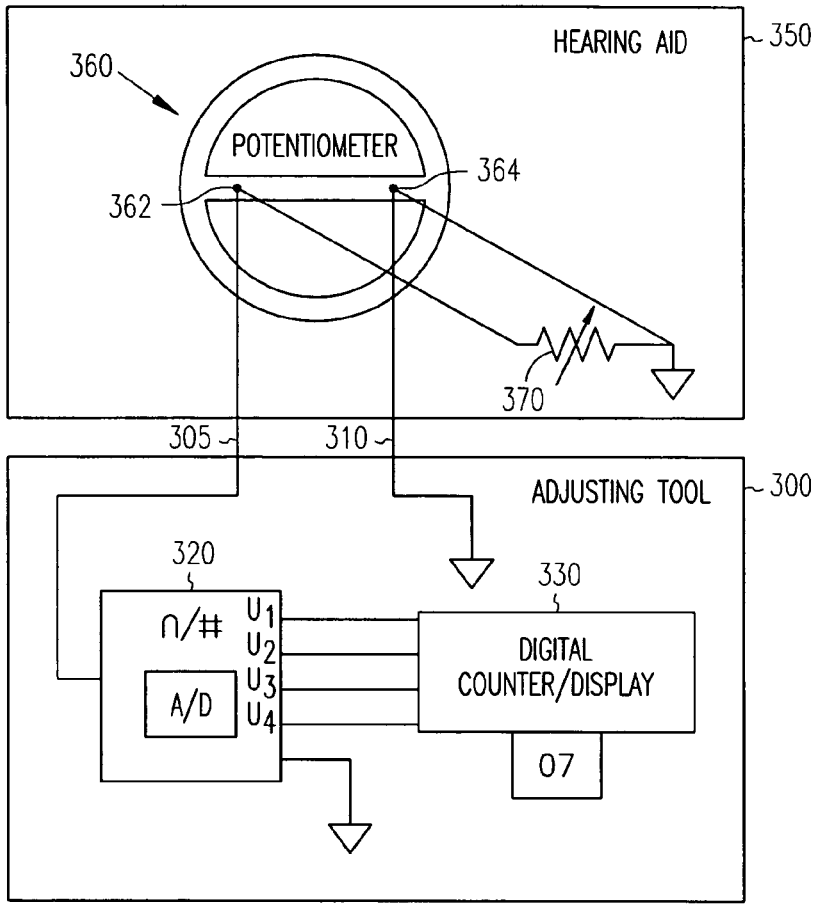
FIG. 3 shows a block diagram of an embodiment of a contact arrangement between a potentiometer of a hearing aid and an adjusting tool that adjusts operating parameters of the hearing aid, according to the teachings of the present invention.

FIG. 3 depicts a block diagram of an embodiment of a contact arrangement between a potentiometer 360 of a hearing aid 350 and an adjusting tool 300 that adjusts operating parameters of hearing aid 350. Potentiometer 360 has receptacles 362, 364 to receive electrical contacts 305, 310 of adjusting tool 300. Receptacles 362, 364 are electrically coupled to an internal variable resistor 370 of potentiometer 360. Potentiometer 360, also referred to as trimmer 360, is mounted in or on a surface of hearing aid 350 and electrically coupled to a circuit of hearing aid 350. The housing of hearing aid 350 and basic housing of potentiometer 360 is plastic.

Adjusting tool 300 includes an analog to digital converter 320 that receives a signal from potentiometer 360 when electrical contacts 305, 310 make conductive contact with receptacles 362, 364 of potentiometer 360. Analog to digital converter 320 provides a signal to a digital display 330 to provide a readout representative of the electrical signal received by electrical contacts 305, 310. Digital display 330 may be constructed as a digital counter display.

Figure 4:
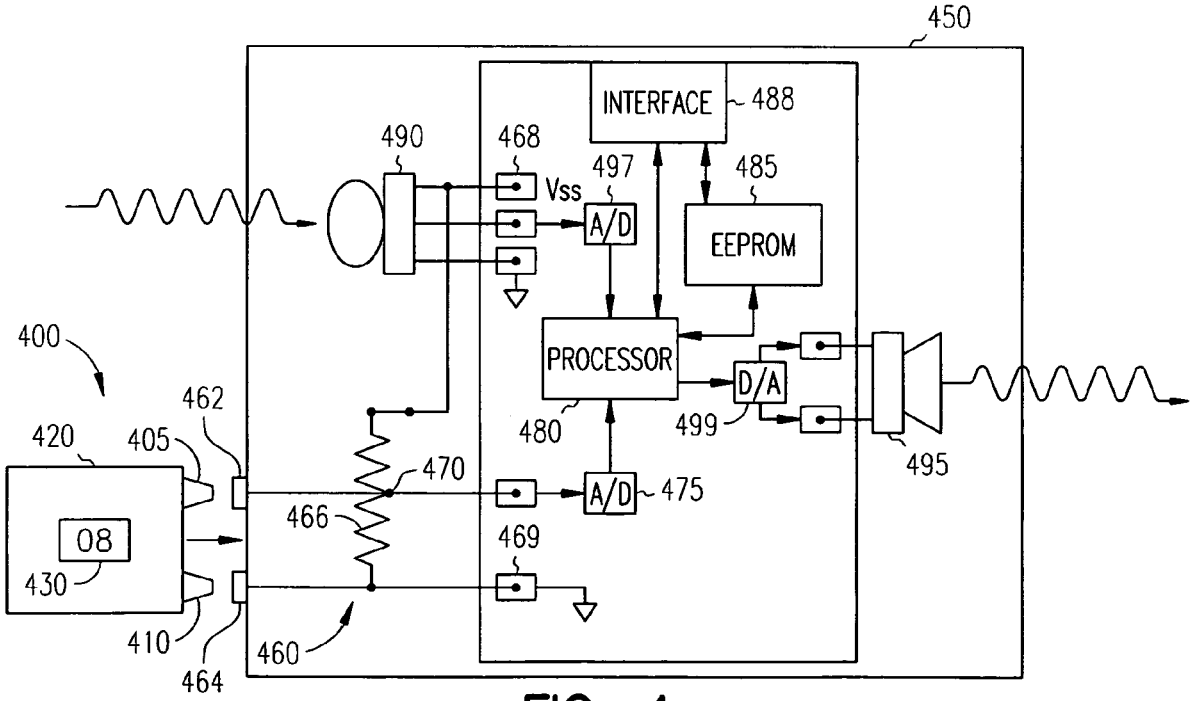
FIG. 4 shows a block diagram of another embodiment of a contact arrangement between a potentiometer of a hearing aid and an adjusting tool that adjusts operating parameters of the hearing aid, according to the teachings of the present invention.

FIG. 4 depicts a block diagram of another embodiment of a contact arrangement between a potentiometer 460 of a hearing aid 450 and an adjusting tool 400 that adjusts operating parameters of hearing aid 450. Adjusting tool 400 includes electrical contacts 405, 410 attached to body 420 on which is mounted or embedded a digital display 430. Alternately, display 430 may be an analog display.

Potentiometer 460 has receptacles 462, 464 to receive electrical contacts 405, 410 of adjusting tool 400, and a variable resistor 466 coupled to receptacles 462, 464. In an embodiment, variable resistor 466 has ends coupled between a supply voltage 468, $V_{SS}$, and a ground 469. Alternately, variable resistor 466 may be coupled between two known voltages. Variable resistor 466 includes an adjustable tap 470 that is electrically coupled to receptacle 462 and a circuit of hearing aid 450. As a result, a voltage that is at a level between the level of voltage supply 468 and ground 469 is provided to both receptacle 462 and a circuit of hearing aid 450. Thus, adjusting tool 400 can receive the same signal that is being supplied from the potentiometer 460 to circuits of hearing aid 450 via the temporary electrical connection made by electrical contacts 405, 410 as potentiometer 466 is adjusted. The electrical signal is also received when electrical contacts 405, 410 physically contact receptacles 462, 464 without adjusting potentiometer 460. In an embodiment, tap 470 is coupled to an analog to digital converter 475 in hearing aid 450.

Analog to digital converter 475 provides a signal to a processor 480 that processor 480 uses to adjust parameters of hearing aid 450. Processor 480 can store and retrieve values for these parameters from a memory 485, such as an EEPROM memory. Processor can also provide these parameters to other units in hearing aid 450 through an interface 488. Processor 480 uses the adjustment signal from potentiometer 466 to modify the parameters for processing an audio signal received at microphone 490 to provide an audio signal at speaker 495 representative of the received audio signal. The signal processing performed by processor 480 includes, but is not limited to, filtering, amplifying, managing volume control, and managing tone control. The audio signal from microphone 490 may be formatted using an analog to digital converter 497 for input to processor 480, and the processed signal provided to speaker 495 can be formatted through a digital to analog converter 499.

Figure 5A:
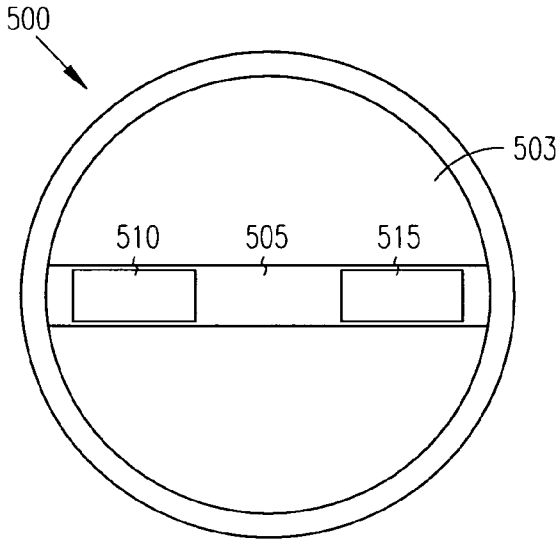
FIG. 5A shows an embodiment of the top of a potentiometer adapted to contact an adjusting tool, according to the teachings of the present invention.

FIG. 5A shows an embodiment of the top of a potentiometer 500 adapted to contact an adjusting tool. Potentiometer 500 includes a top 503 having a slot 505 adapted to receive an adjusting tool mechanism such that the adjusting tool mechanism can turn or adjust a portion of potentiometer 500. In an embodiment, slot 505 is shaped as a conventional screw. Within slot 505 are two receptacles 510 and 515 to receive matching portions from an adjusting tool. Two protruding electrical contacts from an adjusting tool such as discussed with respect to FIGS. 1A-1E and 2A-2B may mate with receptacles 510, 515 adapted to receive these electrical contacts. Receptacles 510, 515 act as electrical contacts for external access to the electrical signal provided by potentiometer to a circuit to which it is coupled. As potentiometer 500 is physically adjusted by an adjusting tool, receptacles 510, 515 maintain their physical relationship to each other, that is, receptacles 510, 515 do not move with respect to each other.

Figure 5B:
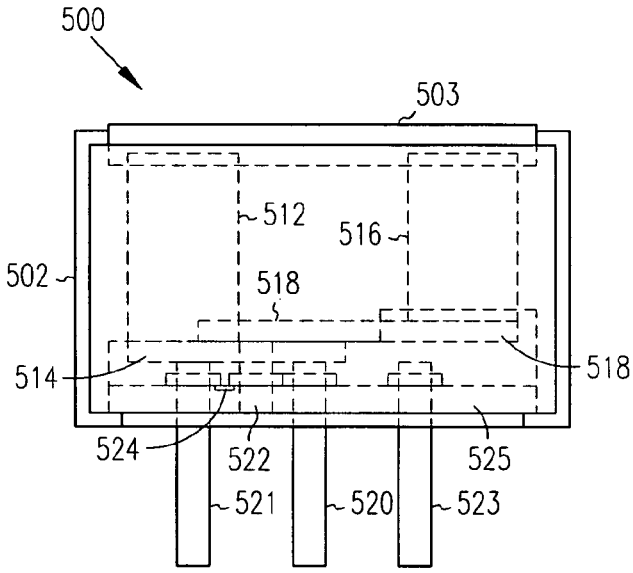
FIG. 5B shows a side view for an embodiment of the potentiometer of FIG. 5A, according to the teachings of the present invention.

FIG. 5B shows a side view for an embodiment of potentiometer 500 of FIG. 5A. Potentiometer 500 includes a housing 502, contacts 512, 516 and four terminals: terminal 520, terminal 521, terminal 522, and terminal 523. Terminals 520-523 are coupled to a resistance plate 525. Terminal 521 and 522 are coupled by a conductive film 524 that makes terminals 521 and 522 electrically the same. In an embodiment, the conductive film 524 is provided by a conductive ink 524 painted on resistance plate 525. Alternately, a mechanical connection such as a wire may be used for conductive film 524. An electrical short connecting terminal 521 and terminal 522 may be realized by a variety of mechanisms depending on an embodiment for a particular application. Between terminals 520-522 and contact 512 and contact 516 are contact plate 514 and contact plate 518. These four terminals are configured to provide a signal that ranges between two fixed signals. In an embodiment, the signal is a voltage level that ranges between two fixed voltages. The fixed voltages may be a voltage supply and ground. Contacts 512, 516 have ends that provide contacts as receptacles 505, 510, respectively, of FIG. 5A.

Figure 5C:
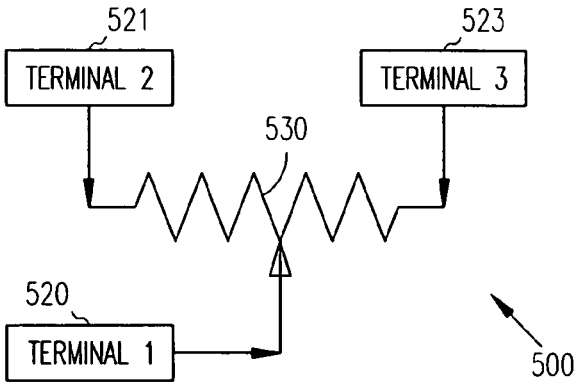
FIG. 5C depicts a representation of electrical connections for the embodiment of the potentiometer of FIG. 5B, according to the teachings of the present invention.

FIG. 5C depicts an electrical representation for the embodiment of potentiometer 500 illustrated in FIG. 2B. Terminals 520, 521, and 523 are adapted to couple to portions of a circuit to which potentiometer 500 is providing a variable resistor 530. Potentiometer 500 provides a fixed resistor between terminal 521 and terminal 523 across which a signal may be applied. Terminal 520 can contact fixed resistor 530 at any point between terminal 521 and terminal 523 creating variable resistor 530. In an embodiment, terminals 520, 521, and 523 are coupled to a circuit of a hearing aid to which it is mounted or embedded.

Figure 5D:
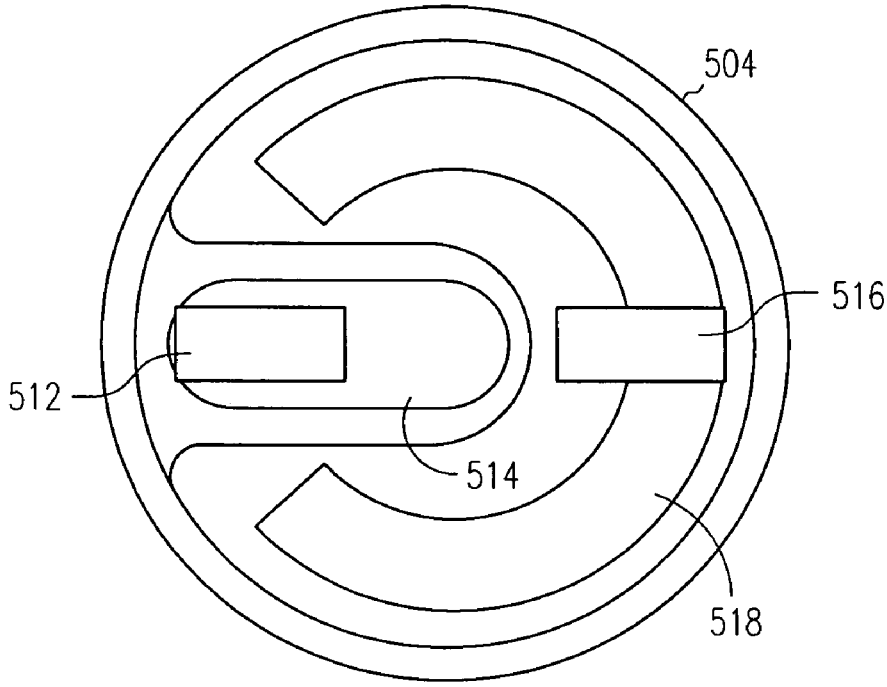
FIG. 5D shows a top view inside the embodiment of the potentiometer of FIG. 5B, according to the teachings of the present invention.

FIG. 5D shows a top view inside the embodiment of potentiometer 500 of FIG. 5B. This illustration demonstrates relative coupling between elements of FIG. 5B. Within body 504, FIG. 5D shows contact 512 and contact 516 with respect to contact plates 514 and contact plate 518.

Figure 5E:
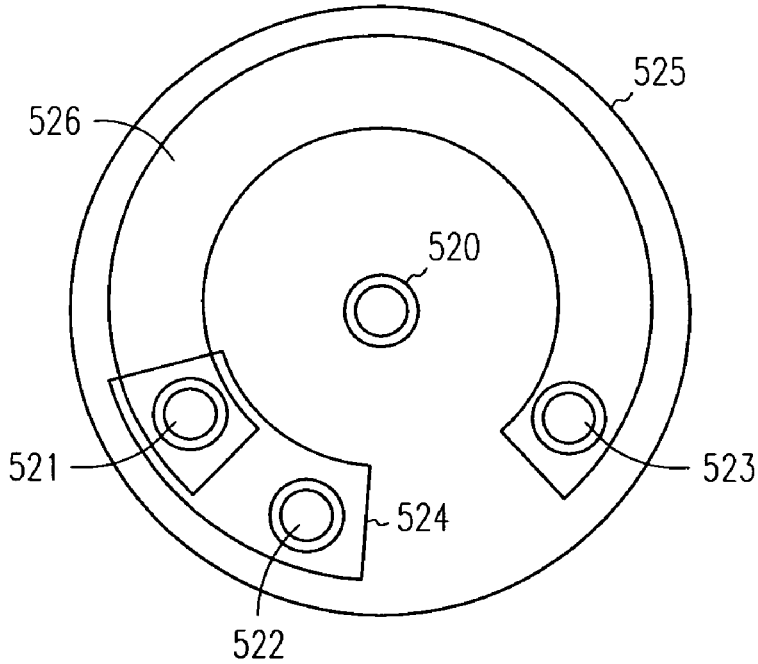
FIG. 5E shows another top view inside the embodiment of the potentiometer of FIG. 5B, according to the teachings of the present invention.

FIG. 5E shows another top view inside the embodiment of potentiometer 500 of FIG. 5B. A resistive film 526 couples terminals 521 and 523 to provide the resistor between these two terminals as shown in the schematic of FIG. 5C. Resistive film 526 may be realized as a resistive ink 526 painted on resistance plate 525. Conductive ink 524 providing electrical conductivity between terminals 521 and 522 may be configured to overlap a resistive ink 526.

FIGS. 5A-5E together show the functional relationship of various elements of potentiometer 500. As slot 505 is turned by an adjusting tool mechanism, contact plate 514, which connects between terminal 520 and resistive ink 526, moves around from terminal 521, and the resistance between terminal 521 and terminal 520 changes. Terminal 520 and terminal 521 are electrically connected to each other through the resistive ink 526. The farther contact plate 514 moves from terminal 521, the higher this resistance becomes relative to terminal 521, as slot 505 is turned. The portion of contact plate 514 that is somewhat in the center of the trimmer body 504 will maintain contact with terminal 520 at the resistance plate 525.

Trimmer body 504 sits on top of resistance plate 525 such that a part of contact plate 514 that is toward the center of the trimmer body makes contact with terminal 520 at all times. The other end of contact plate 514 that is out towards the edge of trimmer body 504 rotates around on resistive ink 526 as the trimmer 500 is turned using slot 505. This other end of contact plate 514 makes contact with contact 512 and the resistive ink 526. Contact plate 514 never touches terminal 521. It only makes contact with the resistive ink 526 and terminal 520.

The orientation of contact 512 and contact 516 never changes, though the whole trimmer body 504 rotates on top of the resistance plate 525. Contact 516 makes contact all during rotation, from just in front of terminal 520 around to terminal 523. The rotational limit is from terminal 521 to terminal 523. In an embodiment, the rotation ranges from about 250 degrees to about 270 degrees. Contact plate 518 maintains pressure on the top of terminal 522. Similarly, contact plate 514 rides on top of terminal 520, maintaining pressure on top of terminal 520. As potentiometer 500 is rotated, contact plate 518 maintains an electrical contact with terminal 522. Contact plates 514, 518 and contacts 512, 516 maintain this relative physical contact as slot 505 is turned. In an embodiment, contact 512 is oval shaped and contact plate 518 resembles letter C.

In an embodiment, terminal 522 extends further out from resistance plate 525 than terminal 521 and the other terminals to avoid contact with other elements. Terminal 521 is in contact with the resistive ink 526, at the end of resistive ink 526. Contact 516 is on terminal 522, which is basically the same as terminal 521 since terminals 521 and 522 are electrically the same. In an embodiment, terminal 521 is coupled to ground.

Terminals 520, 521, and 523 are configured to couple to an electrical circuit to which potentiometer 500 is mated. The electrical circuit is coupled to terminal 520 and terminal 521 to provide a voltage between these terminals that can be used to adjust the electrical circuit. In an embodiment for potentiometer 500 in a hearing aid, terminal 520 and terminal 521 are effectively inside the hearing aid. The top portion of potentiometer 500 effectively makes terminal 520 and terminal 521 accessible on the outside of potentiometer 500 via contacts 512, 516 having receptacles 510, 515, respectively, in slot 505. As a result of this arrangement, an adjusting tool device measures exactly the same voltage that the circuit is receiving.

A voltage is applied to potentiometer 500 at terminal 523. It is a fixed voltage applied from a circuit to which it forms a part. In an embodiment, terminal 521 is coupled to a ground of the circuit. As potentiometer 500 is turned, the voltage on terminal 520 will vary from zero volts all the way up to the voltage that is on terminal 523. The voltage that is on terminal 520 is related to the amount of resistance, or the ratio of the resistance, at a point between terminals 523 and 521. It is dividing the voltage between terminal 521 and terminal 523 based on its position on the resistive ink 526. The closer contact plate 514 is to terminal 523, the higher the voltage is at terminal 520. In an embodiment, as contact plate 514 turns counter-clockwise towards terminal 521, the voltage goes down to zero volts, which is the voltage level at terminal 521. The resistor, electrically corresponding to the resistor of FIG. 5C, is the resistive 526 ink between terminal 523 and terminal 521. The amount of resistance between terminal 521 and any point on resistive ink 526 is proportionate to the distance from terminal 521. There is a voltage drop between terminal 523 and terminal 521 that is a fixed voltage. In an embodiment, the fixed voltage is a constant voltage.

The electrical circuit, to which potentiometer is a part, receives the voltage between terminal 520 and terminal 521. Terminal 520 is in electrical contact with contact 512, which is on resistive ink 526. Contact 512 and terminal 520 are both picking off a voltage at the same time by virtue of where contact plate 514 is on that resistive ink 526. In an embodiment, terminal 520 provides a contact for the electrical circuit of a hearing aid of which it is part and contact 512 provides a contact for the benefit of the adjusting tool to adjust parameters of the hearing aid. Terminal 520 and contact 512 allow the adjusting tool and the hearing aid to receive the same voltage.

In an embodiment for a potentiometer of FIGS. 5A-5E, housing 502 and body 504 are plastic. Potentiometer receptacles 512, 518 providing access to contacts 512, 516, respectively are a gold-plated metal. Resistance plate 525 is a ceramic, and terminals 520-523 are a metal such as copper wire or gold wire. Conductive ink 524 may be a conductive film or replaced with a metal wire. Contact plates 514, 518 are a conductive material such as a gold-plated conductive material. Using a gold-plate conductive material provides a good electrical contact that does not readily oxidize.

Figure 6A:
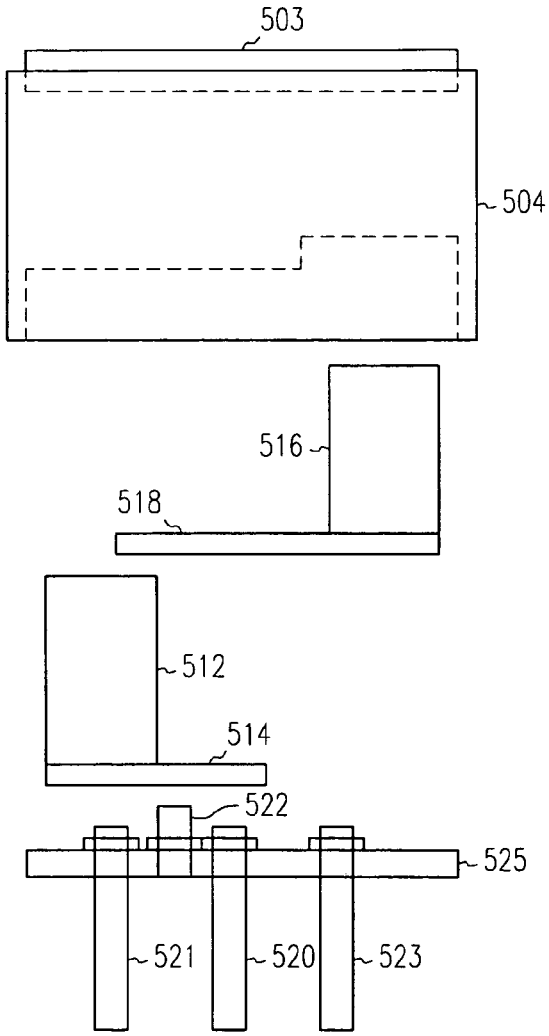
FIGS. 6A-6E depicts an embodiment for a method of assembling a potentiometer adapted to provide an electrical signal accessible to an adjustment apparatus for physically adjusting the potentiometer, according to the teachings of the present invention.

FIGS. 6A-6E depicts an embodiment for a method of assembling a potentiometer adapted to provide an electrical signal accessible to an adjustment apparatus for physically adjusting the potentiometer. FIG. 6A illustrates various elements for the potentiometer 500 of FIGS. 5A-5E at an early stage of assembly, where four partial assemblies are completed. Trimmer body 504 is provided with a top 503 having slot 505 and receptacle openings (slot 505 and receptacle openings not shown). Contact 516 is mounted on contact plate 518 as one partial assembly. Contact 512 is mounted on contact plate 514 as another partial assembly. Terminals 520-523 are mounted on resistance plate 525 as a fourth partial assembly. Though not shown, resistive ink 526 and conductive ink 524 have been applied to the terminal assembly on resistance plate 525.

Figure 6B:
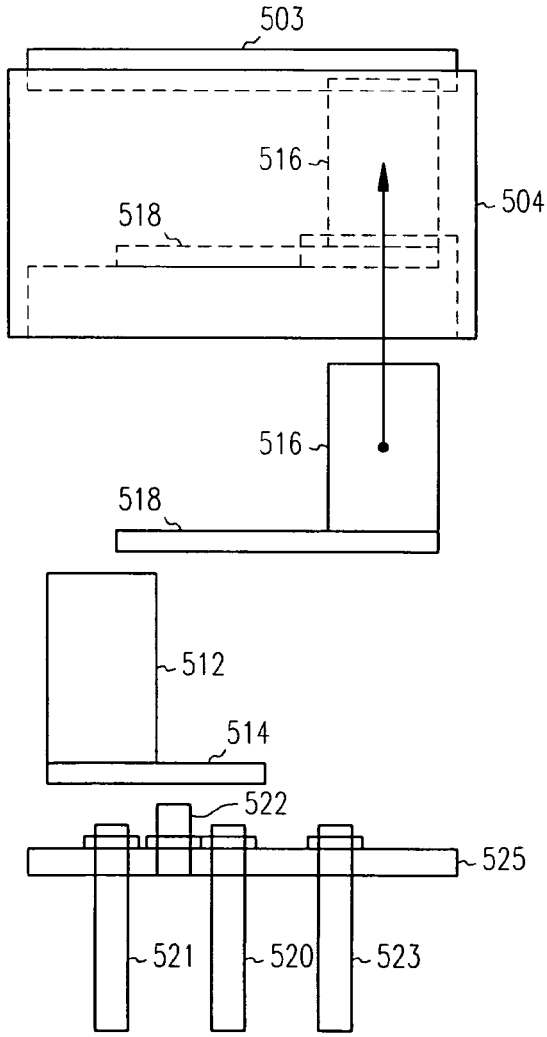
Figure 6C:
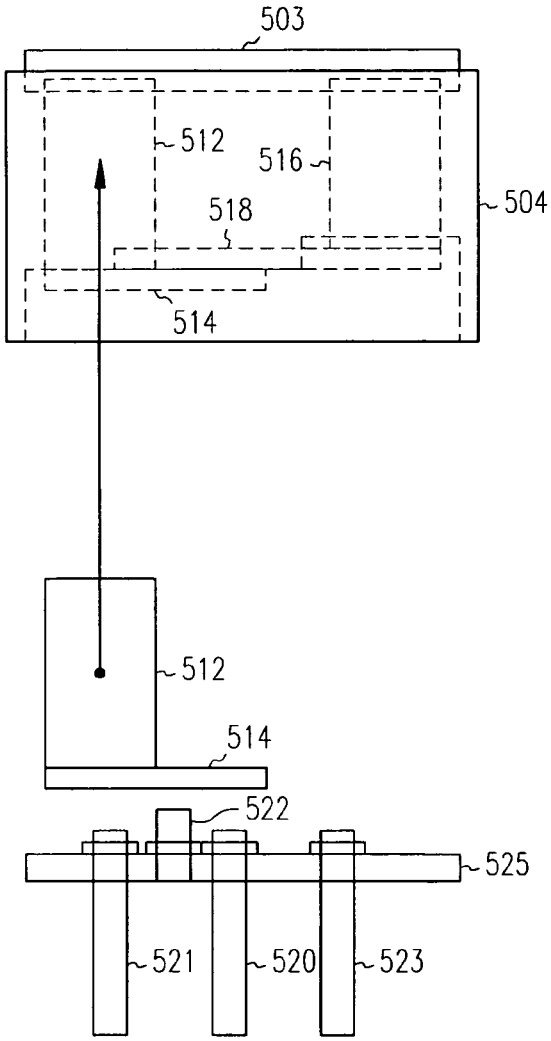

FIG. 6B shows the contact 516-contact plate 518 assembly inserted into trimmer body 504. Contact 516 is arranged into an opening in slot 505 to provide receptacle 515. FIG. 6C shows the contact 512-contact plate 514 assembly inserted into trimmer body 504. Contact 512 is arranged into an opening in slot 505 to provide receptacle 510.

Figure 6D:
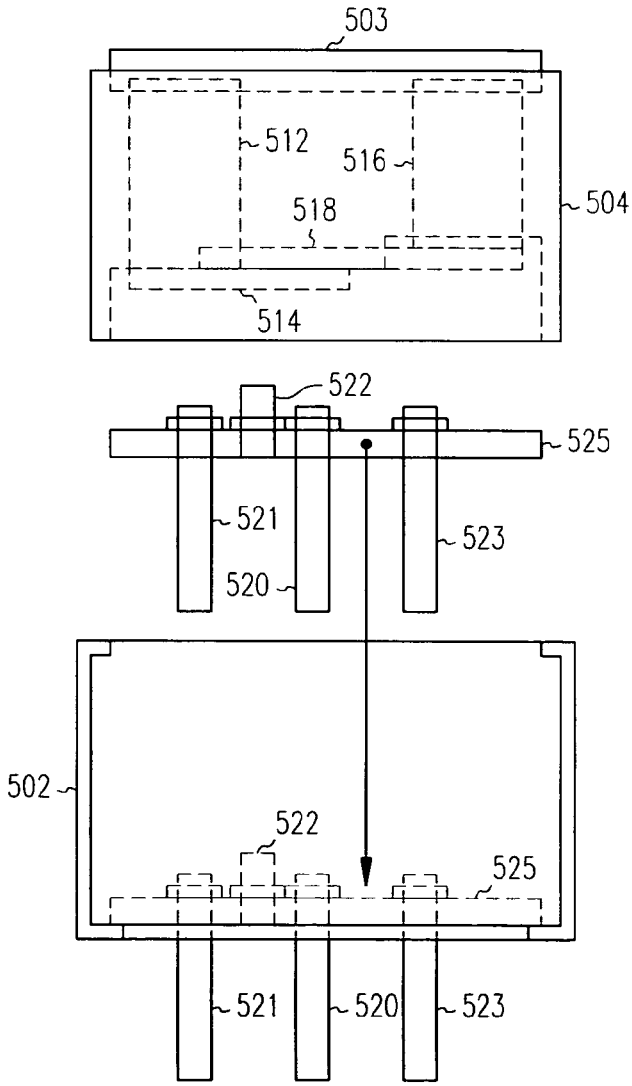
Figure 6E:
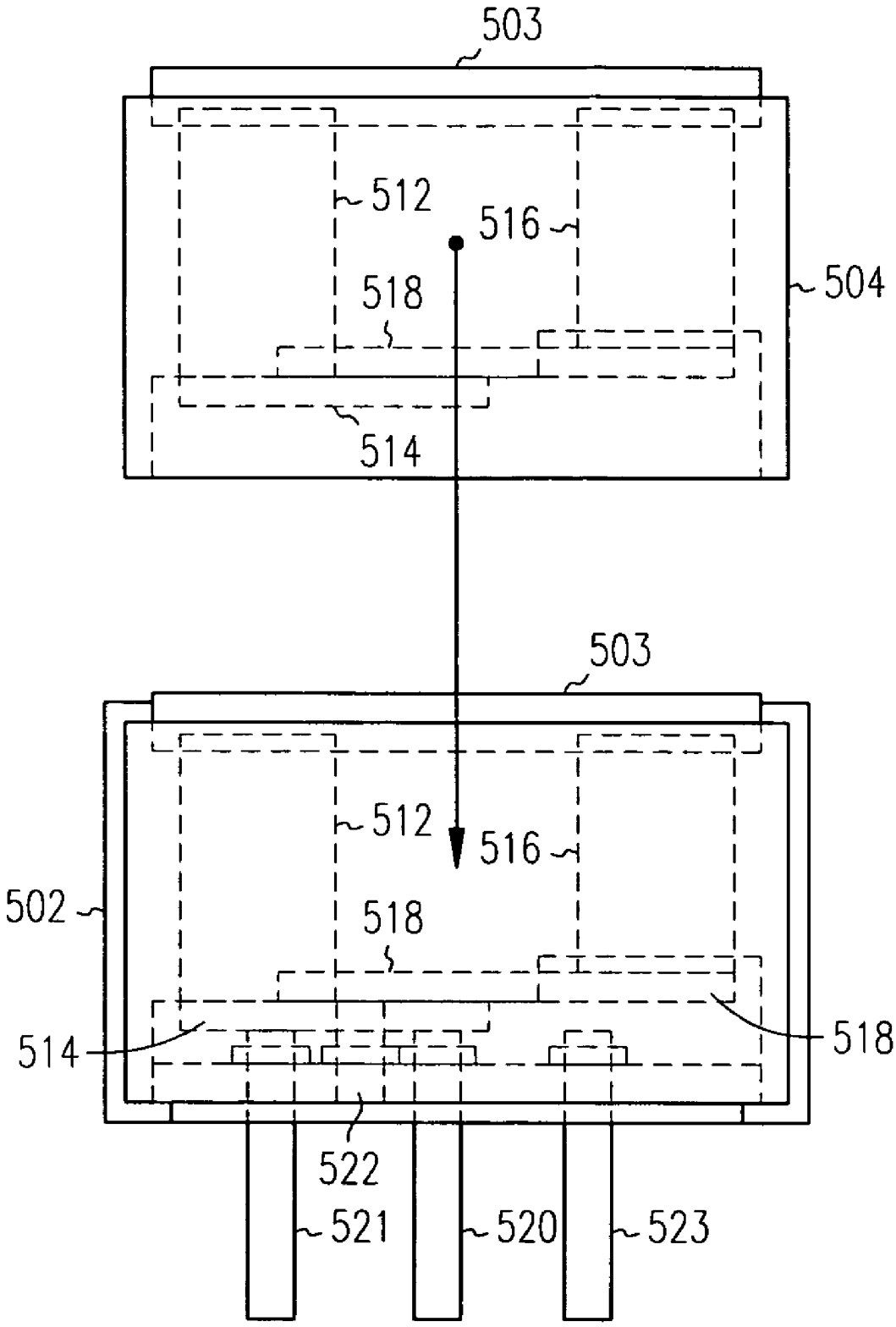

FIG. 6D shows the terminals 520-523-resistance plate 525 assembly placed into housing 502. Terminals 520-523 extend from housing 502 to provide contact to the circuit to which potentiometer 500 is mated. FIG. 6E shows trimmer body 504 preassembled with contacts 512, 516 and contact plates 514, 518 mounted into housing 502. In mounting this preassembly, appropriate physical contacts of contact plates 514, 518 to terminals 520-523 are made.

Figure 7A:
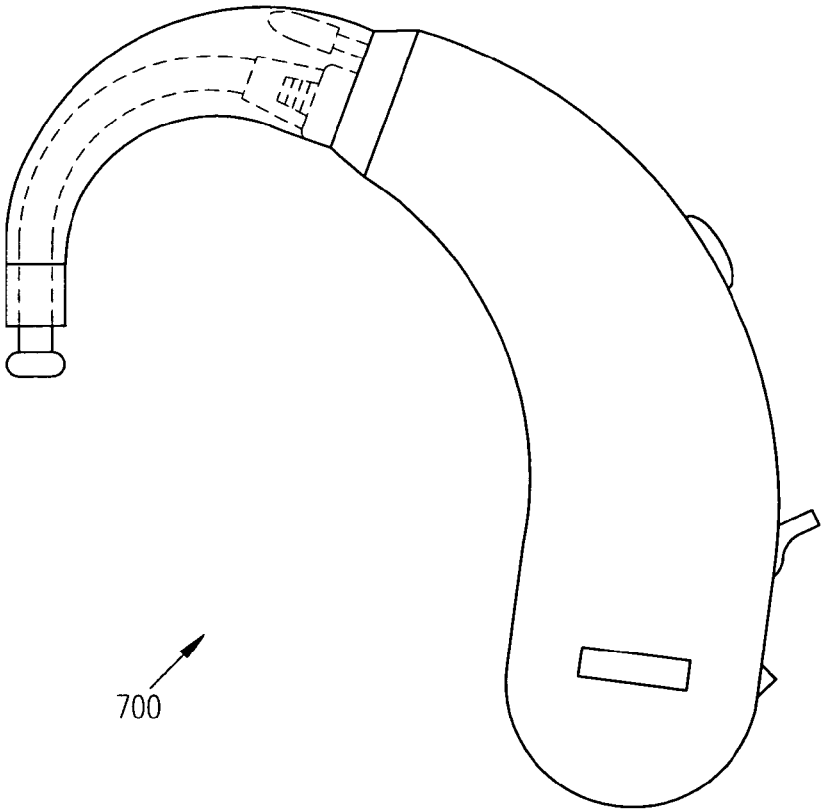
FIGS. 7A-7B show an embodiment of a behind-the-ear hearing aid having multiple potentiometers that are adapted for use with an adjusting tool, according to the teachings of the present invention.
Figure 7B:
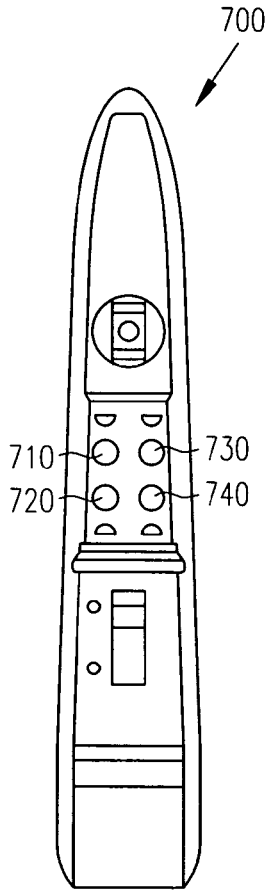

A potentiometer, such as an embodiment of FIGS. 5A-5E, can be mounted on the surface of a hearing aid or embedded in the hearing aid. With the potentiometer embedded in the hearing aid, the accessible slot may be configured or located at the level of the surface of the hearing aid. Alternately, the slot can be arranged to be situated above the hearing aid surface. In an embodiment, multiple potentiometers may be configured for a hearing aid. Each of the multiple potentiometers may be adapted to adjust one or more parameters of the hearing aid. A hearing aid having one or more potentiometers may be constructed for use in the ear, in the ear canal, and behind the ear. FIG. 7A shows a side view of a behind-the-ear hearing 700 having multiple potentiometers adapted for use with an adjusting tool. FIG. 7B shows behind-the-ear hearing aid 700 having potentiometers 710, 720, 730, and 740 that are adapted for use with an adjusting tool.

Figure 8:
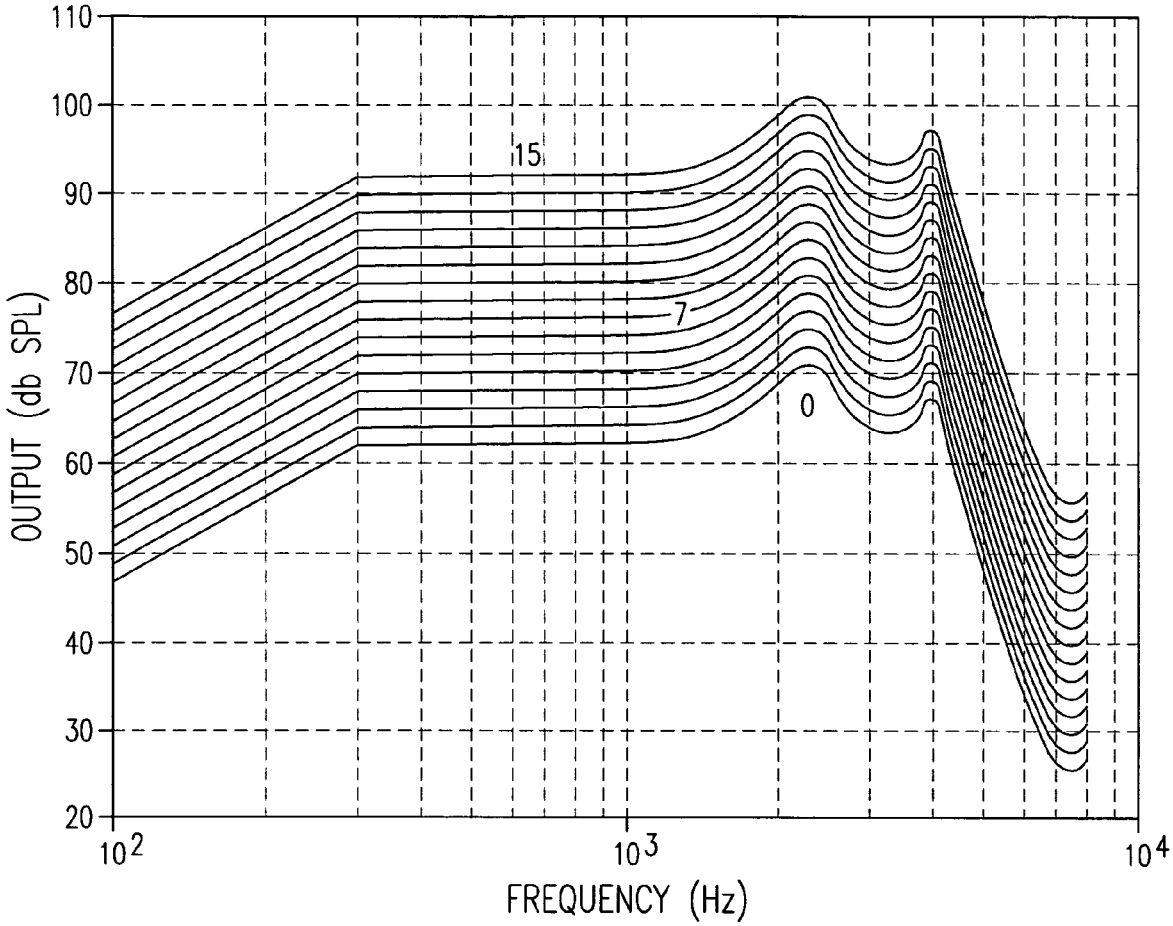
FIG. 8 shows a response curve for an embodiment of a hearing aid adjusted with an adjusting tool, according to the teachings of the present invention.

FIG. 8 illustrates a parameter that can be set using embodiments for an adjusting tool adapted for adjusting a potentiometer of a hearing aid and for receiving a signal representative of the adjustment being made. In FIG. 8, response curves for a hearing aid correlated to different readings from an adjusting tool are shown. In this embodiment, the adjusting tool has a display that provides one of sixteen possible integer numbers correlated to sixteen settings for the gain of the hearing aid being adjusted as a function of frequency. Reading 0 is correlated to parameters providing the least gain. Reading 7 is correlated to parameters providing gain at a mid range. Reading 15 is correlated to parameters providing the largest gain. Other embodiments provide for a wider range of adjustment, adjustment of different parameters, and a variety of formats for reading out indicators through an adjusting tool representative of a signal applied by a potentiometer to a hearing aid to adjust one or more parameters of the hearing aid.

In various embodiments, a hearing aid is configured to have parameters adjusted by an adjustment tool that receives a signal from the hearing aid that is representative of the signal used to adjust a parameter of the hearing aid. The hearing aid includes a signal processing circuit to process an electrical signal according to one or more parameters, and a potentiometer coupled to the signal processing circuit to adjust one or more of these parameters. The potentiometer has a means for adjusting the potentiometer that provides an adjustment signal at contacts accessible exterior to the hearing aid. The adjustment signal is also provided by the potentiometer to the signal processing circuit to adjust the parameter of the one or more parameters. The potentiometer is mounted in or on a housing of the hearing aid.

The adjustment tool for the hearing aid may be realized as an adjusting tool to adjust the potentiometer. The adjusting tool is configured with electrical contacts that electrically couple to the contacts of the means for adjusting the potentiometer as the adjusting tool adjusts the potentiometer. In an embodiment, the adjusting tool has two electrical contacts to electrically couple to the contacts of the means for adjusting the potentiometer.

The potentiometer may be realized as a number of potentiometers. Each of these potentiometers may be configured to adjust a different parameter of the hearing aid, where each potentiometer has a means for adjustment that provides an adjustment signal at contacts accessible exterior to the hearing aid. The adjustment signal is also provided by each potentiometer to the signal processing circuit of the hearing aid. Each potentiometer may be mounted in or on a surface of a housing of the hearing aid.

Embodiments for an adjusting tool and potentiometer similar to those described herein provide for fitting digital hearing aids easily, conveniently, and quickly. Furthermore, the fitting of such digital hearing aids can be performed without the use of a computer.

Although specific embodiments have been illustrated and described herein, it will be appreciated by those of ordinary skill in the art that any arrangement that is calculated to achieve the same purpose may be substituted for the specific embodiments shown. This application is intended to cover any adaptations or variations of the present invention. It is to be understood that the above description is intended to be illustrative, and not restrictive. Combinations of the above embodiments, and other embodiments, will be apparent to those of skill in the art upon studying the above description. The scope of the present invention includes any other applications in which the above structures and fabrication methods are used. The scope of the present invention should be determined with reference to the appended claims, along with the full scope of equivalents to which such claims are entitled.

What is claimed is:

1. An adjusting tool comprising:

a first electrical contact in a head of the adjusting tool;

a second electrical contact in the head of the adjusting tool, the second electrical contact insulated from direct electrical contact with the first electrical contact, the first and second electrical contacts configured to receive a signal applied between the first electrical contact and the second electrical contact as the adjusting tool engages an object to be adjusted, wherein each of the first electrical contact and the second electrical contact includes a conductive body situated in a recess in the head of the adjusting tool having a portion of the conductive body protruding outside the recess, the conductive body movable inside the recess, further including a spring coupled to the conductive body, the spring to compress to allow the conductive body to move into the recess as the first contact and the second contact are forced into contact with a receptacle, the first contact and the second contact are forced to maintain electrical contact with the receptacle.

2. The adjusting tool of claim 1, wherein at least one of the first electrical contact and the second electrical contact is electrically insulated from the head of the adjusting tool.

3. The adjusting tool of claim 1, comprising:

an electronic circuit housed in the adjusting tool to process the signal and to provide an output related to the signal.

4. The adjusting tool of claim 3, wherein the output includes a visible display related to the signal.

5. The adjusting tool of claim 3, wherein the electronic circuit includes an analog-to-digital converter to convert the signal into a digital signal, and wherein the output includes a visible digital display coupled to the analog-to-digital converter.

6. The adjusting tool of claim 1, wherein the head of the adjusting tool is configured as a flat head.

7. The adjusting tool of claim 1, wherein the head of the adjusting tool is configured to physically adjust a potentiometer.

8. The adjusting tool of claim 1, wherein the adjusting tool includes a display disposed on an end of the adjusting tool opposite the first and second electrical contacts.

9. The adjusting tool of claim 1, wherein the adjustment tool is configured to adjust a hearing aid.

10. An adjusting tool comprising:

a first electrical contact in a head of the adjusting tool;

a second electrical contact in the head of the adjusting tool, the second electrical contact insulated from direct electrical contact with the first electrical contact, the first and second electrical contacts configured to receive a signal applied between the first electrical contact and the second electrical contact as the adjusting tool engages an object to be adjusted, wherein each of the first electrical contact and the second electrical contact include:

a conductive cylinder with a flat end and a tapered end movable inside a cylindrical cavity in the head, the conductive cylinder having a cylindrical collar fixed between the flat end and the tapered end with an outside diameter larger than an outside diameter of the conductive cylinder, the collar movable inside a recess in the head with a diameter larger than a diameter of the cylindrical cavity between a first ledge and a second ledge, the tapered end extending past an exterior surface of the head through an opening in the head;

a flat washer having an outside diameter positioned inside the recess between the collar and the first ledge and a hole through which the conductive cylinder slides;

a spring wrapped around the conductive cylinder between the washer and the collar to force the collar away from the washer toward the second ledge and to force the tapered end to extend through the opening until the collar meets the second ledge of the recess, the spring to compress to allow the conductive cylinder to move into the cylindrical cavity as the first contact and the second contact are forced into contact with a receptacle.

11. The adjusting tool of claim 10, wherein the head is configured to adjust a potentiometer.

12. The adjusting tool of claim 10, wherein the adjusting tool includes a digital display.

13. The adjusting tool of claim 10, wherein the adjusting tool includes a display disposed on an end of the adjusting tool opposite the first and second electrical contacts.

14. The adjusting tool of claim 10, comprising:

an electronic circuit housed in the adjusting tool to process the signal and to provide an output related to the signal.

15. The adjusting tool of claim 14, wherein the output includes a visible display related to the signal.

16. The adjusting tool of claim 14, wherein the electronic circuit includes an analog-to-digital converter to convert the signal into a digital signal, and wherein the output includes a visible digital display coupled to the analog-to-digital converter.

17. The adjusting tool of claim 10, wherein the head of the adjusting tool is configured as a flat head.

18. The adjusting tool of claim 10, wherein the adjustment tool is configured to adjust a hearing aid.

19. A hearing aid and an adjustment tool, comprising:

a signal processing circuit in the hearing aid to process an electrical signal according to one or more parameters;

a potentiometer coupled to the signal processing circuit to adjust a parameter of the one or more parameters, the potentiometer having a means for adjusting the potentiometer that provides an adjustment signal at contacts accessible exterior to the hearing aid, the adjustment signal provided by the potentiometer to the signal processing circuit to adjust the parameter of the one or more parameters, the potentiometer mounted in or on a housing of the hearing aid; and the adjusting tool to adjust the potentiometer, the adjusting tool configured with electrical contacts that electrically couple to the contacts of the means for adjusting the potentiometer as the adjusting tool adjusts the potentiometer, the adjusting tool including:

a first electrical contact in a head of the adjusting tool;

a second electrical contact in the head of the adjusting tool, the second electrical contact insulated from direct electrical contact with the first electrical contact, the first and second electrical contacts configured to receive a signal applied between the first electrical contact and the second electrical contact as the adjusting tool engages the potentiometer to be adjusted, the adjusting tool being separate from the potentiometer and the hearing aid, the adjusting tool configured to operably engage the potentiometer with the head of the adjusting tool.

20. The hearing aid and adjustment tool of claim 19, wherein the adjusting tool includes a display to display a representation of the received signal.

21. The hearing aid and adjustment tool of claim 19, wherein the signal processing circuit includes a digital signal processing circuit.

22. The hearing aid and adjustment tool of claim 19, wherein the hearing aid further includes a plurality of potentiometers, each of the plurality of potentiometers configured to adjust a different parameter, each potentiometer having a means for adjustment that provides an adjustment signal at contacts accessible exterior to the hearing aid, the adjustment signal provided by each potentiometer to the signal processing circuit to adjust the parameter, each potentiometer mounted in or on a surface of a housing of the hearing aid.

* * * * *

UNITED STATES PATENT AND TRADEMARK OFFICE

CERTIFICATE OF CORRECTION

PATENT NO. : 7,668,328 B2
APPLICATION NO. : 10/827706
DATED : February 23, 2010
INVENTOR(S) : Rosenthal et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1217 days.

Signed and Sealed this

Twenty-eighth Day of December, 2010

David J. Kappos

David J. Kappos
*Director of the United States Patent and Trademark Office*